US011721304B2

(12) United States Patent
Chen et al.

(10) Patent No.: US 11,721,304 B2
(45) Date of Patent: Aug. 8, 2023

(54) METHOD AND DEVICE OF COMPENSATING BRIGHTNESS FOR DISPLAY DEVICE, AND METHOD AND DEVICE OF DRIVING DISPLAY DEVICE

(71) Applicants: Chengdu BOE Optoelectronics Technology Co., Ltd., Sichuan (CN); BOE Technology Group Co., Ltd., Beijing (CN)

(72) Inventors: Wenbin Chen, Beijing (CN); Rongjian Yan, Beijing (CN); Guangjun Song, Beijing (CN)

(73) Assignees: CHENGDU BOE OPTOELECTRONICS TECHNOLOGY CO., LTD., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/788,360

(22) PCT Filed: Sep. 1, 2021

(86) PCT No.: PCT/CN2021/115960
§ 371 (c)(1),
(2) Date: Jun. 23, 2022

(87) PCT Pub. No.: WO2022/088954
PCT Pub. Date: May 5, 2022

(65) Prior Publication Data

US 2023/0029179 A1 Jan. 26, 2023

(30) Foreign Application Priority Data

Oct. 30, 2020 (CN) ..... 202011188003.4

(51) Int. Cl.
*G09G 5/10* (2006.01)

(52) U.S. Cl.
CPC ..... *G09G 5/10* (2013.01); *G09G 2320/0233* (2013.01); *G09G 2320/0276* (2013.01);
(Continued)

(58) Field of Classification Search
CPC ..... G09G 5/10; G09G 2320/0233; G09G 2320/0276; G09G 2320/0285;
(Continued)

(56) References Cited

U.S. PATENT DOCUMENTS 8,421,740 B2 * 4/2013 Watanuki ..... G09G 3/3426 345/207
10,510,289 B2 * 12/2019 Wang ..... G09G 3/20
2019/0103056 A1 * 4/2019 Xu ..... G09G 3/3258

FOREIGN PATENT DOCUMENTS

CN 107464524 A 12/2017
CN 107633808 A 1/2018
(Continued)

*Primary Examiner* — Antonio Xavier
(74) *Attorney, Agent, or Firm* — WHDA, LLP

(57) ABSTRACT

A method and device of compensating a brightness for a display device and a method and device of driving a display device are provided. The method of compensating a brightness includes: acquiring display brightness data of multiple frames of pictures displayed after a display picture of the display device is switched from a first grayscale value to a second grayscale value; determining a brightness coefficient of each frame of picture according to the display brightness data; determining a reference picture and at least one frame of to-be-compensated picture according to the brightness coefficient; and determining a grayscale compensation value, so that a ratio of a display brightness of each frame of to-be-compensated picture displayed by the display device to a display brightness of the reference picture displayed by the display device is greater than or equal to a preset first brightness threshold.

20 Claims, 6 Drawing Sheets

(52) U.S. Cl.
CPC ..... *G09G 2320/0285* (2013.01); *G09G 2320/0626* (2013.01); *G09G 2360/16* (2013.01)

(58) Field of Classification Search
CPC ..... G09G 2320/0626; G09G 2360/16; G09G 3/006; G09G 3/2022; G09G 2320/0252; G09G 2340/16; G09G 3/20; G09G 2320/0673
See application file for complete search history.

(56) References Cited

FOREIGN PATENT DOCUMENTS

| | | | |
|---|---|---|---|
| CN | 108510965 | A | 9/2018 |
| CN | 110689588 | A | 1/2020 |
| CN | 112216243 | A | 1/2021 |

* cited by examiner

Second grayscale value

| First grayscale value | $G_1$ | $G_2$ | $G_3$ | $G_4$ | $G_5$ | $G_6$ | $G_7$ | $G_8$ | $G_9$ | $G_{10}$ |
|---|---|---|---|---|---|---|---|---|---|---|
| $G_1$ | | * | * | * | * | * | * | * | * | * |
| $G_2$ | | | * | * | * | * | * | * | * | * |
| $G_3$ | | | | * | * | * | * | * | * | * |
| $G_4$ | | | | | * | * | * | * | * | * |
| $G_5$ | | | | | | * | * | * | * | * |
| $G_6$ | | | | | | | * | * | * | * |
| $G_7$ | | | | | | | | * | * | * |
| $G_8$ | | | | | | | | | * | * |
| $G_9$ | | | | | | | | | | * |
| $G_{10}$ | | | | | | | | | | |

METHOD AND DEVICE OF COMPENSATING BRIGHTNESS FOR DISPLAY DEVICE, AND METHOD AND DEVICE OF DRIVING DISPLAY DEVICE

CROSS REFERENCE TO RELATED APPLICATION(S)

This application is a Section 371 National Stage Application of International Application No. PCT/CN2021/115960, filed on Sep. 1, 2021, entitled "METHOD AND DEVICE OF COMPENSATING BRIGHTNESS FOR DISPLAY DEVICE, AND METHOD AND DEVICE OF DRIVING DISPLAY DEVICE", which claims priority to Chinese patent Application No. 202011188003.4, filed on Oct. 30, 2020, the content of which are incorporated herein by reference in their entirety.

TECHNICAL FIELD

The present disclosure relates to a field of display technology, and in particular to a method and device of compensating a brightness for a display device, and a method and device for driving a display device.

BACKGROUND

A sliding tail may exist in an existing display device during display. That is, when an object is dragged on a screen of a display device, an abnormally displayed picture may appear in a direction opposite to a movement of the dragged object. For example, dragging white text on a screen with a black background may produce a dark or colored "tail" in a direction opposite to the dragging. The sliding tail may seriously affect a user's visual experience when using the display device.

SUMMARY

The present disclosure provides a method of compensating a brightness for a display device, a method of driving a display device, and devices thereof.

According to a first aspect of the present disclosure, there is provided a method of compensating a brightness for a display device, including:

acquiring display brightness data of multiple frames of pictures displayed after a display picture of the display device is switched from a first grayscale value to a second grayscale value;

determining a brightness coefficient of each frame of picture in the multiple frames of pictures according to the display brightness data of the multiple frames of pictures;

determining a reference picture and at least one frame of to-be-compensated picture in the multiple frames of pictures according to the brightness coefficient; and determining a grayscale compensation value of the at least one frame of to-be-compensated picture, so that a ratio of a display brightness of each frame of to-be-compensated picture in the at least one frame of to-be-compensated picture displayed by the display device to a display brightness of the reference picture displayed by the display device is greater than or equal to a preset first brightness threshold.

In some embodiments, the acquiring display brightness data of multiple frames of pictures displayed after a display picture of the display device is switched from a first grayscale value to a second grayscale value includes:

displaying multiple frames of second pictures with the second grayscale value sequentially after the display device displays a first picture with the first grayscale value; and collecting display brightness data of the multiple frames of second pictures.

In some embodiments, the brightness coefficient of each frame of picture in the multiple frames of pictures is determined according to:

$$M(i)=L_i/\max\{L_1,L_2,\ldots,L_N\}$$

wherein M(i) represents a brightness coefficient of an i-th frame of picture in the multiple frames of images, $L_i$ represents a brightness of the i-th frame of picture, i is a natural number, i=1, 2, . . . , N, and N is the number of the multiple frames of pictures.

In some embodiments, the determining a reference picture and at least one frame of to-be-compensated picture in the multiple frames of pictures according to the brightness coefficient includes:

comparing the brightness coefficient of each frame of picture with a preset second brightness threshold respectively; and determining, in response to a brightness coefficient of a former frame of picture in two adjacent frames of pictures being less than the second brightness threshold and a brightness coefficient of a latter frame of picture in the two adjacent frames of pictures being greater than or equal to the second brightness threshold, the latter frame of picture as the reference picture, and determining each frame of picture before the latter frame of picture as the at least one frame of to-be-compensated picture.

In some embodiments, the determining a grayscale compensation value of the at least one frame of to-be-compensated picture, so that a ratio of a display brightness of each frame of to-be-compensated picture in the at least one frame of to-be-compensated picture displayed by the display device to a display brightness of the reference picture displayed by the display device is greater than or equal to a preset first brightness threshold includes:

operation a, selecting a grayscale adjustment step;

operation b, determining an adjusted grayscale value according to a sum of the second grayscale value and the selected grayscale adjustment step;

operation c, acquiring display brightness data of the at least one frame of to-be-compensated picture and the reference picture displayed after the display picture of the display device is switched from the first grayscale value to the determined adjusted grayscale value;

repeating operations a to c in response to a ratio of the collected display brightness of each frame of to-be-compensated picture to the display brightness of the reference picture being less than the preset first brightness threshold, until the ratio of the display brightness of each frame of to-be-compensated picture in the at least one frame of to-be-compensated picture to the display brightness of the reference picture is greater than or equal to the preset first brightness threshold; and determining the selected grayscale adjustment step as the grayscale compensation value of the at least one frame of to-be-compensated picture.

In some embodiments, the acquiring display brightness data of the at least one frame of to-be-compensated picture and the reference picture displayed after the display picture of the display device is switched from the first grayscale value to the determined adjusted grayscale value includes:

displaying the at least one frame of to-be-compensated picture and the reference picture sequentially after the display device displays a first picture with the first grayscale value, by using the determined adjusted grayscale value as a grayscale value of the at least one frame to be compensated and the reference picture; and collecting the display brightness of the at least one frame of to-be-compensated picture and the reference picture.

In some embodiments, the display device includes a Gamma unit;

wherein the grayscale adjustment step is selected according to an integer multiple of a grayscale represented by a minimum resolution of a binding point voltage of the Gamma unit.

In some embodiments, the display picture is a red picture, a green picture or a blue picture, and the first grayscale value is less than the second grayscale value.

According to a second aspect of the present disclosure, there is provided a method of driving a display device, including:

receiving a grayscale value of a next frame of to-be-displayed picture;

comparing the grayscale value of the next frame of to-be-displayed picture with a grayscale value of a picture currently being displayed;

querying, in response to the grayscale value of the next frame of to-be-displayed picture being greater than the grayscale value of the picture currently being displayed, a brightness compensation lookup table to acquire a grayscale compensation value;

calculating a compensated grayscale value of the next frame of to-be-displayed picture according to the grayscale compensation value; and driving the display device using the compensated grayscale value;

wherein the grayscale compensation value in the brightness compensation lookup table is determined based on the method according to the first aspect of the present disclosure.

In some embodiments, the querying a brightness compensation lookup table to acquire a grayscale compensation value includes:

determining a first lower limit grayscale value a and a first upper limit grayscale value a' in the brightness compensation lookup table according to the grayscale value m of the picture currently being displayed, so that $a \le m \le a'$;

determining a second lower limit grayscale value b and the second upper limit grayscale value b' in the brightness compensation lookup table according to the grayscale value n of the next frame of to-be-displayed picture, so that $b \le n \le b'$; and querying the brightness compensation lookup table according to the a, a', b, and b', to acquire a grayscale compensation value $G_{off}(a, b)$ for switching from the first lower limit grayscale value a to the second lower limit grayscale value b, a grayscale compensation value $G_{off}(a', b)$ for switching from the first upper limit grayscale value a' to the second lower limit grayscale value b, a grayscale compensation value $G_{off}(a, b')$ for switching from the first lower limit grayscale value a to the second upper limit grayscale value b', and a grayscale compensation value $G_{off}(a', b')$ for switching from the first upper limit grayscale value a' to the second upper limit grayscale value b'.

In some embodiments, the compensated grayscale value m' of the next frame of to-be-displayed picture is calculated according to:

$$m' = m + \frac{(m-a)(n-b)}{(a'-a)(b'-b)} \times [G_{off}(a, b) + G_{off}(a', b') - G_{off}(a', b') - G_{off}(a, b')].$$

In some embodiments, the brightness compensation lookup table includes a red compensation lookup table, a green compensation lookup table and a blue compensation lookup table;

wherein the querying the brightness compensation lookup table to acquire a grayscale compensation value includes:

querying the red compensation lookup table, the green compensation lookup table, and the blue compensation lookup table respectively to acquire a red grayscale compensation value, a green grayscale compensation value, and a blue grayscale compensation value, respectively.

According to a third aspect of the present disclosure, there is provided a device of compensating a brightness, including:

a memory configured to store program instructions; and a processor configured to execute the program instructions so as to perform the method according to the first aspect of the present disclosure.

According to a fourth aspect of the present disclosure, there is provided a display driver, including:

a data processor including a compensation register having a brightness compensation lookup table stored therein, wherein a grayscale compensation value in the brightness compensation lookup table is determined based on the method according to the first aspect of the present disclosure; and the data processor is configured to:

receive a grayscale value of a next frame of to-be-displayed picture;

compare the grayscale value of the next frame of to-be-displayed picture with a grayscale value of a picture currently being displayed;

query, in response to the grayscale value of the next frame of to-be-displayed picture being greater than the grayscale value of the picture currently being displayed, the brightness compensation lookup table to acquire the grayscale compensation value;

calculate a compensated grayscale value of the next frame of to-be-displayed picture according to the grayscale compensation value; and drive a display device using the compensated grayscale value.

According to a fifth aspect of the present disclosure, there is provided a display device, including:

a display panel; and the display driver according to according to the fourth aspect of the present disclosure.

BRIEF DESCRIPTION OF THE DRAWINGS

The above and other objects, features and advantages of embodiments of the present disclosure will be clearer through the following description of the embodiments of the present disclosure with reference to the accompanying drawings. It should be noted that throughout the accompanying drawings, the same or similar reference numerals represent the same or similar components.

DETAILED DESCRIPTION OF EMBODIMENTS

Figure 1:
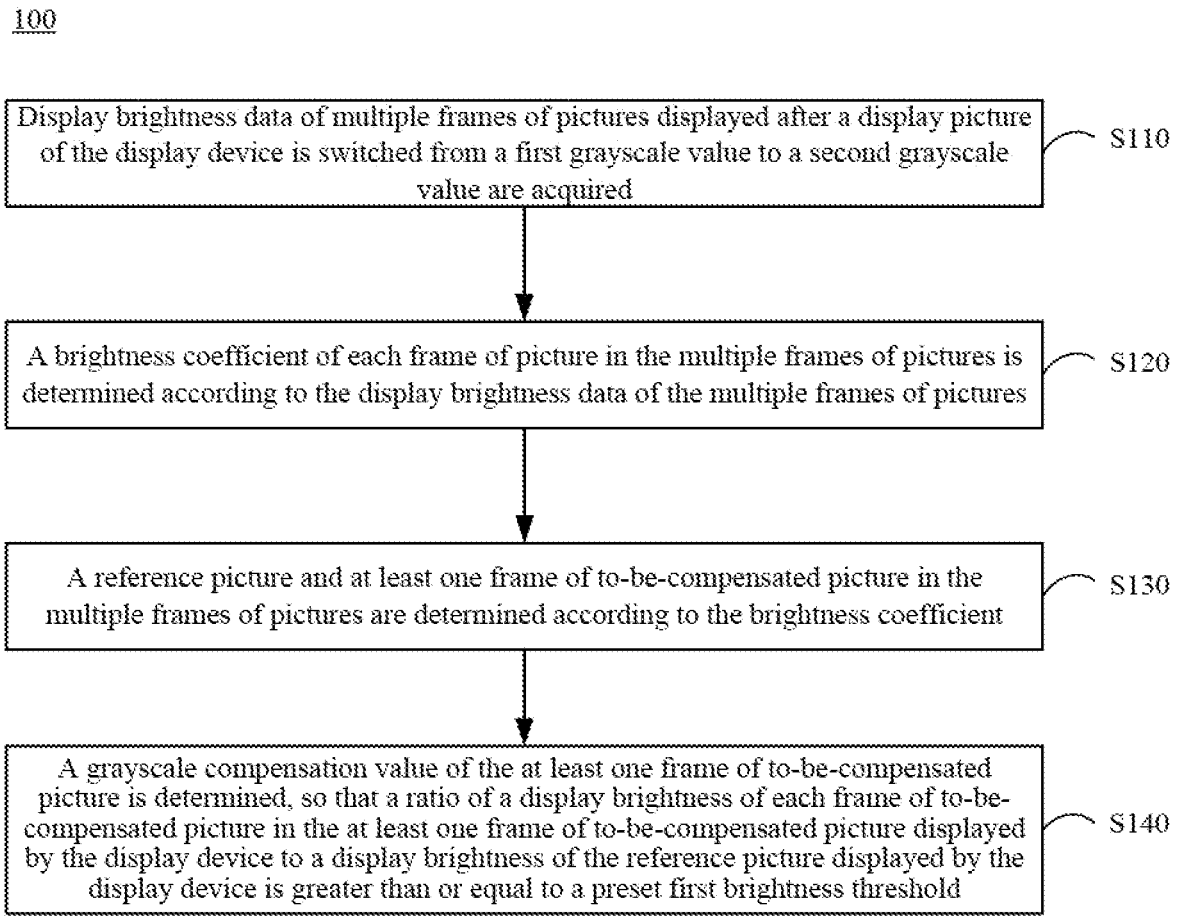
FIG. 1 schematically shows a flowchart of a method of compensating a brightness for a display device according to an embodiment of the present disclosure.

In order to make the purposes, technical solutions and advantages of the embodiments of the present disclosure clearer, the technical solutions in the embodiments of the present disclosure will be clearly and completely described below with reference to the accompanying drawings in the embodiments of the present disclosure. It may be understood that the described embodiments are some, but not all, of the embodiments of the present disclosure. Based on the described embodiments of the present disclosure, all other embodiments acquired by those skilled in the art without any creative effort fall within the scope of protection of the present disclosure. In the following description, some specific embodiments are only for the purpose of description, and should not be construed as any limitation to the present disclosure, but are merely examples of the embodiments of the present disclosure. When it may cause confusion in the understanding of the present disclosure, conventional structures or configurations may be omitted. It should be noted that the shapes and dimensions of components in the drawings do not necessarily reflect actual sizes and/or ratios, but merely illustrate the content of the embodiments of the present disclosure.

Unless otherwise defined, technical or scientific terms used in the embodiments of the present disclosure shall have the ordinary meaning as understood by those skilled in the art. "First", "second" and similar words used in the embodiments of the present disclosure do not represent any order, quantity or importance, but are only used to distinguish different components.

In addition, in the description of the embodiments of the present disclosure, the term "connected to" or "connected" may mean that two components are directly connected, or may mean that two components are connected via one or more other components. Furthermore, the two components may be connected or coupled by wire or wirelessly.

FIG. 1 schematically shows a flowchart of a method 100 for compensating a brightness of a display device according to an embodiment of the present disclosure. As shown in FIG. 1, the method 100 for compensating a brightness according to an embodiment of the present disclosure may include the following steps.

In step S110, display brightness data of multiple frames of pictures displayed after a display picture of the display device is switched from a first grayscale value to a second grayscale value are acquired.

In step S120, a brightness coefficient of each frame of picture in the multiple frames of pictures is determined according to the display brightness data of the multiple frames of pictures.

In step S130, a reference picture and at least one frame of to-be-compensated picture in the multiple frames of pictures are determined according to the brightness coefficient.

In step S140, a grayscale compensation value of the at least one frame of to-be-compensated picture is determined, so that a ratio of a display brightness of each frame of to-be-compensated picture in the at least one frame of to-be-compensated picture displayed by the display device to a display brightness of the reference picture displayed by the display device is greater than or equal to a preset first brightness threshold.

According to the embodiments of the present disclosure, the display brightness data of multiple frames of pictures displayed after the display picture of the display device is switched from the first grayscale value to the second grayscale value is acquired by simulating a scene where the display device performs a picture switching and by measuring a display brightness of the display picture.

Figure 2:
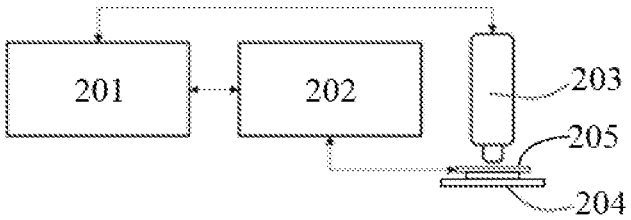
FIG. 2 schematically shows a block diagram of a test device for collecting a display brightness of a display picture.

In the embodiments of the present disclosure, the scene where the display device performs the picture switching may be simulated and the display brightness of the display picture may be measured by using a test device as shown in FIG. 2.

FIG. 2 schematically shows a block diagram of a test device for collecting a display brightness of a display picture according to an embodiment of the present disclosure. As shown in FIG. 2, the test device includes a controller 201, a picture generator 202, an optical test probe 203 and a test stage 204 on which a display device 205 to be tested is placed. According to an embodiment, the controller 201 may be a processor or a personal computer for controlling an operation of the picture generator 202 and the optical test probe 203. The picture generator 202 is connected to the controller 201. The picture generator 202 receives instructions from the controller 201, generates a picture to be displayed on the display device 205 according to the received instructions, and sends the generated picture to the display device 205 in a specific order for display. The optical test probe 203 is used to detect the display brightness of the display picture during a process of displaying a picture on the display device 205. The test stage 204 is used to support and fix the display device 205 during testing.

According to an embodiment, firstly, the display device 205 or a display module (e.g., a display screen) detached from the display device 205 is fixed on the test stage 204, and the display device 205 is connected to a patch cable of the picture generator 202 at the same time. The controller 201 sends a control signal to the picture generator 202 so as to control the picture generator 202 to generate, for example, a red picture (first picture) with the first grayscale value, and control the picture generator 202 to send the red picture with the first grayscale value to the display device 205 for display. According to an embodiment, the picture generator 202 may be controlled to generate only one frame of red picture with the first grayscale value, and then only one frame of red picture with the first grayscale value is displayed by the display device 205 before the picture switching. The picture generator 202 may also be controlled to generate multiple frames of red pictures with the first grayscale value, and then the multiple frames of red pictures with the first grayscale value are displayed through the display device 205 before the picture switching, which is not limited in the embodiments of the present disclosure.

Next, according to an embodiment, the controller 201 is continuously used to control the picture generator 202 to generate multiple frames of red pictures (second pictures) with the second grayscale value, and control the picture generator 202 to sequentially send the multiple frames of red pictures with the second grayscale value to the display device 205 for display. When the display device 205 displays each frame of red picture with the second grayscale value, the optical test probe 203 is used to synchronously collect display brightness data of the multiple frames of red pictures with the second grayscale value, and the collected display brightness data is fed back to the controller 201 for storage.

Figure 3:
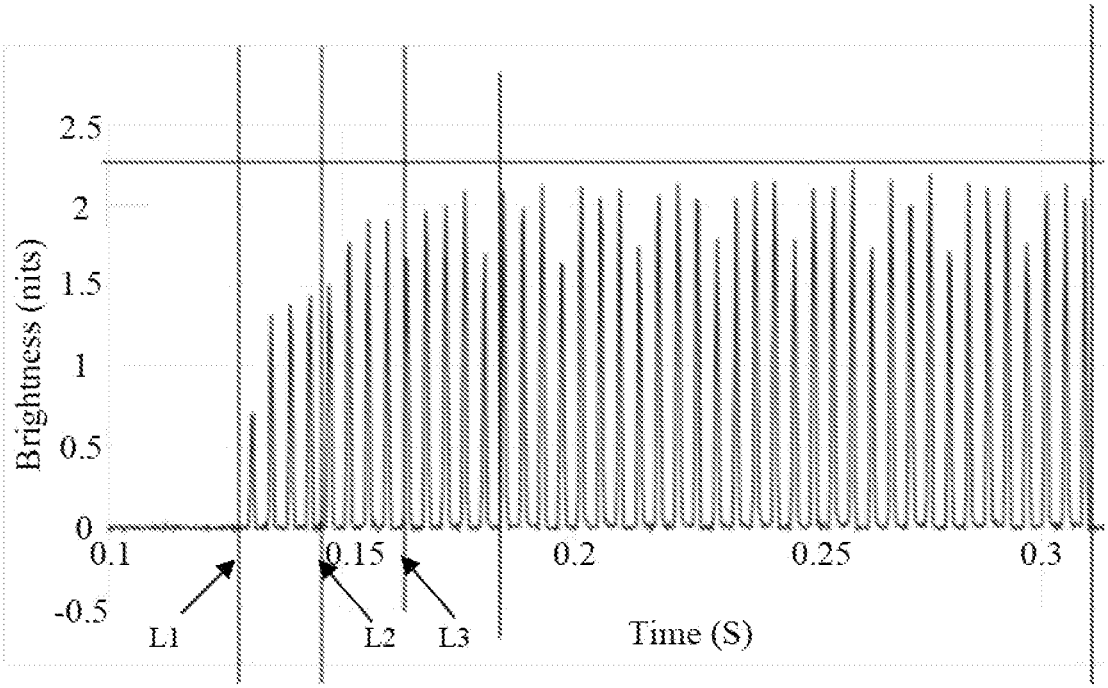
FIG. 3 schematically shows a change of a display brightness of multiple frames of display pictures after a picture switching.

FIG. 3 schematically shows a change of a display brightness of multiple frames of display pictures after a picture switching. As shown in FIG. 3, a region between a vertical line L1 and a vertical line L2 represents displayed 4 frames of first pictures with the first grayscale value, and a region between the vertical line L2 and a vertical line L3 represents displayed 4 frames of second pictures with the second grayscale value. A switching from the first pictures with the first grayscale value to the second pictures with the second grayscale value occurs at the vertical line L2, and a display brightness of the $1^{st}$ frame and the $2^{nd}$ frame with the second grayscale values after the picture switching occurs is obviously less than a display brightness of the $3^{rd}$ frame and the $4^{th}$ frame after the picture switching occurs. This is caused by an insufficient charging and discharging speed of a storage capacitor in a pixel driving circuit of the display device 205. When the picture switching occurs in the display device 205, a charge stored in the storage capacitor may not be adjusted to a required value in time, so that a current flowing through a light-emitting unit is lower than a desired current, which may cause the display brightness of the display picture to be low. The low display brightness of the display picture may lead to a sliding tail. In the embodiments of the present disclosure, the sliding tail may be improved by performing a brightness compensation on the above-mentioned several initial frames of pictures.

It should be noted that, in the above-mentioned embodiments, only the red picture is described as an example. However, according to an embodiment, pictures of other colors, such as green pictures or blue pictures, may be used to acquire compensation parameters for different colors, so as to visually improve or eliminate a color sliding tail. In the embodiments of the present disclosure, the controller 201 may control the picture generator 202 to respectively generate solid color pictures of the red picture, green picture and blue picture, and respectively collect brightness changes of pictures in the display device 205 when solid color images of different colors are switched.

In addition, it should be noted that the number of second pictures with the second grayscale value generated by the picture generator 202 may be determined according to display performance of the display device 205. For example, if it is determined through testing that a display brightness of a picture is stable after 3 frames of second pictures are displayed in the display device 205, then starting from the $4^{th}$ frame of second picture, a display brightness of subsequent second pictures may be considered as a desired brightness. The desired brightness is a brightness of the picture when the display device 205 stably displays at the second grayscale value. Thus, the picture generator 202 may be controlled to generate 4 frames or more than 4 frames of second pictures, for example, 5 frames of second pictures, 10 frames of second pictures, and the like. It may be understood that the more second pictures are displayed, the more favorable it is to select more pictures for a brightness compensation, thereby improving an accuracy of compensation. Therefore, the number of the second pictures displayed in the test may be selected according to test time and performance of a product. Time when the desired picture brightness is achieved after the picture switching is determined according to the performance of the product, thereby determining the number of pictures that need to be displayed to achieve the desired picture brightness. On the premise of ensuring the desired picture brightness, the number of second pictures is selected according to test time requirements in a product production process.

Next, in the several initial frames of pictures switched from the first picture with the first grayscale value to the second picture with the second grayscale value, the number of pictures to be subjected to the brightness compensation is determined. According to an embodiment, a brightness coefficient of each frame of second picture in the multiple frames of second pictures is calculated, and the at least one frame of to-be-compensated picture in the multiple frames of pictures is determined according to the brightness coefficient of each frame of second picture in the multiple frames of second pictures. In the embodiments of the present disclosure, a brightness coefficient of a frame of picture represents a degree of closeness between a display brightness of the frame of picture and a desired picture brightness of the same grayscale value (second grayscale value). The larger the brightness coefficient, the closer the display brightness of the picture is to the desired picture brightness. The smaller the brightness coefficient, the greater a difference between the display brightness of the picture and the desired picture brightness, so that a sliding tail of the display picture may be caused, and a brightness compensation is required. According to an embodiment, a first brightness threshold $TH_1$ is set according to compensation requirements for the display device 205. For example, when the first picture with the first grayscale value is switched to the second picture with the second grayscale value, if it is desired that a brightness of an initial frame of picture in the display device 205 after the picture switching reaches 95% of the desired picture brightness, then the first brightness threshold $TH_1$ may be set to 95%. Thus, a second picture whose display brightness does not reach 95% of the desired picture brightness is screened out as a to-be-compensated picture, and a brightness compensation is performed on the second picture. By adjusting a value of the second grayscale value one or more times, that is, determining a grayscale compensation value for the second grayscale value, a display brightness of the to-be-compensated picture may reach 95% of the desired picture brightness. It may be understood that in other embodiments, a degree of closeness between a display brightness of a frame of picture and a desired picture brightness of the same grayscale value may be determined by comparing a difference between the display brightness of the frame of picture and the desired picture brightness of the same grayscale value.

In addition, in the embodiments of the present disclosure, a display brightness of the selected reference picture may be used as the desired picture brightness, because when the at least one frame of to-be-compensated picture is determined, it is considered that a display brightness of a picture displayed after the at least one frame of to-be-compensated picture has reached a required degree of closeness to the desired picture brightness, and no compensation is required.

According to the embodiments of the present disclosure, the sliding tail caused by insufficient display brightness of several initial frames of pictures may be improved by compensating the display brightness of the several initial frames of pictures after the display picture is switched. In addition, a color of a trailing may be adjusted while improving the sliding tail by determining compensation parameters for red, green and blue, for example, determining the number of to-be-compensated pictures and the grayscale compensation value, which may further improves a user's visual experience.

Figure 4:
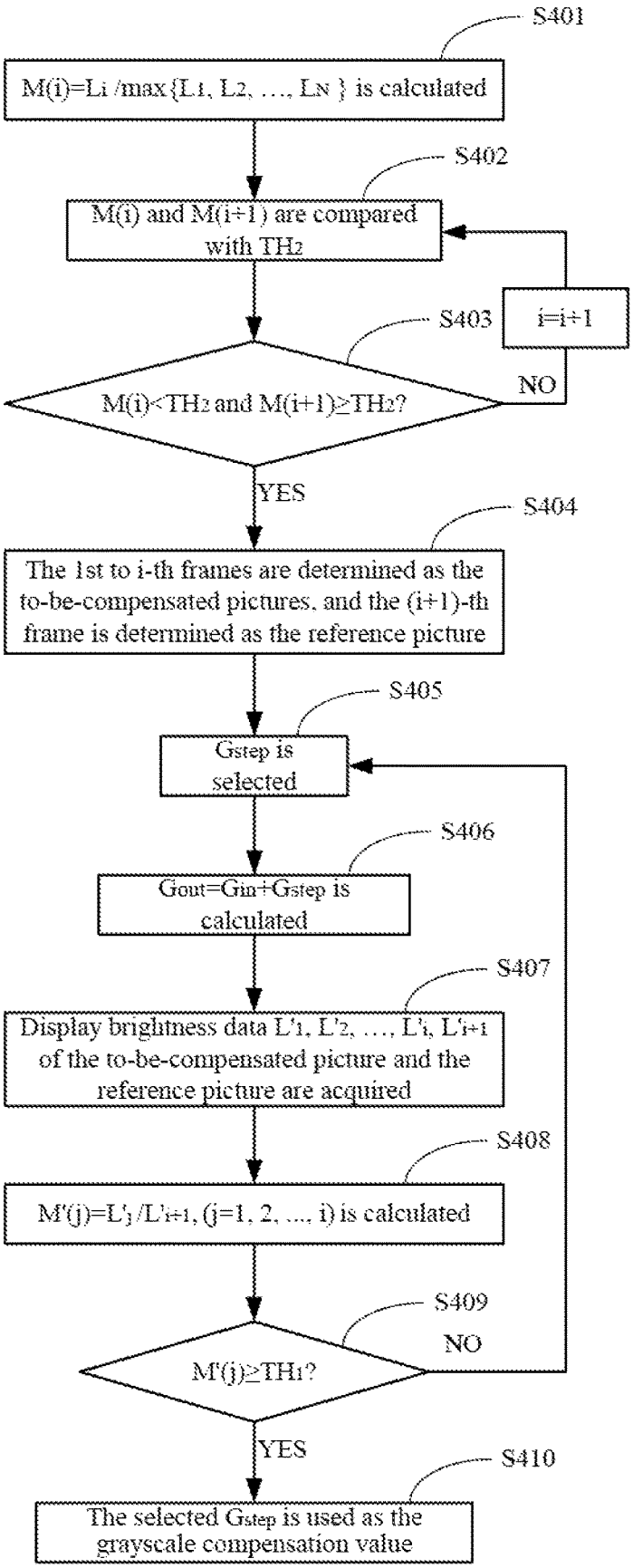
FIG. 4 schematically shows a process of determining compensation parameters according to an embodiment of the present disclosure.

FIG. 4 schematically illustrates a process of determining compensation parameters according to an embodiment of the present disclosure.

As shown in FIG. 4, in step S401, the brightness coefficient of each frame of picture in the multiple frames of pictures is calculated. According to an embodiment, the brightness coefficient of each frame of picture is calculated according to the following expression (1):

$$M(i)=L_i/\max\{L_1,L_2,\ldots,L_N\} \quad (1)$$

In the formula, M(i) represents a brightness coefficient of an i-th frame of picture in the multiple frames of pictures, $L_i$ represents a brightness of the i-th frame of picture, i is a natural number, i=1, 2, . . . , N, and N is the number of the multiple frames of pictures. max{•} operator means to take the maximum of all values. According to the embodiments of the present disclosure, the value of N may be selected according to the test time and performance of the product for the number of the second pictures displayed in the test. For example, N may be a value of 3 or less for a common product. N may be a value greater than 3 for a product with a poor performance.

Next, in step S402, the brightness coefficient M(i) of each frame of picture is compared with the preset second brightness threshold $TH_2$, respectively. According to an embodiment, in two adjacent frames of pictures, for example, in the i-th frame of picture and the (i+1)-th frame of picture, if a brightness coefficient M(i) of the former frame is less than the second brightness threshold $TH_2$ and a brightness coefficient M(i+1) of the latter frame of picture is greater than or equal to the second brightness threshold $TH_2$, then the latter frame of picture, that is, the (i+1)-th frame of picture, is determined as the reference picture, and each frame of picture before the latter frame of picture, that is, the $1^{st}$ frame of picture, the $2^{nd}$ frame of picture, . . . , the i-th frame of picture, are determined as the to-be-compensated picture. As shown in FIG. 4, in step S402, brightness coefficients M(1) and M(2) of the $1^{st}$ frame of picture and the $2^{nd}$ frame of picture are compared with the second brightness threshold $TH_2$, and it is determined whether $M(1)<TH_2$ and $M(2)\geq TH_2$ are satisfied, as shown in step S403. If the condition is satisfied, then the $1^{st}$ frame is determined as the to-be-compensated picture, and the $2^{nd}$ frame of picture is determined as the reference picture in step S404. If the condition is not satisfied, then i is added by 1 and the process returns to step S402. By comparing M(2) and M(3) with $TH_2$, if $M(2)<TH_2$ and $M(3)\geq TH_2$ are satisfied, the $1^{st}$ frame of picture and the $2^{nd}$ frame of picture are determined as the to-be-compensated pictures, and the $3^{rd}$ frame of picture is determined as the reference picture. If a comparison result determined in step S403 is still "No", then i is added by 1 and the process returns to step S402 to continue a cyclic comparison process. If the comparison result determined in step S403 is "Yes", then step S404 is executed, and the $1^{st}$ to i-th frames are determined as the to-be-compensated pictures, and the (i+1)-th frame is determined as the reference picture.

Here, similar to the meaning of the first brightness threshold $TH_1$, the second brightness threshold $TH_2$ is also used to represent a degree of closeness between display brightness of display pictures. For example, the second brightness threshold $TH_2$ represents a degree of closeness of the display brightness of the at least one frame of to-be-compensated picture to the display brightness of the reference picture. According to an embodiment, the display brightness of the reference picture is used to represent a stable display brightness after the picture switching, that is, the desired picture brightness. Therefore, the second brightness threshold $TH_2$ represents a proportion of the display brightness of the at least one frame of to-be-compensated picture relative to the desired picture brightness. It should be noted that although the first brightness threshold $TH_1$ and the second brightness threshold $TH_2$ represent the same attribute, there are differences in setting basis and numerical value between the two. As mentioned above, the first brightness threshold $TH_1$ is mainly set according to compensation requirements for the display device. For example, if it is desired that an effect of a compensated display device is better, a relatively large first brightness threshold $TH_1$ may be set, for example, $TH_1$=98%. But again, a higher compensation requirement may lead to a higher cost. The second brightness threshold $TH_2$ is a relative brightness requirement between the at least one frame of to-be-compensated picture and the reference picture on the premise that it has been determined that the compensation requirements may be achieved by displaying the at least one frame of to-be-compensated picture and the reference picture. The second brightness threshold $TH_2$ may be determined according to performance of the display device.

Next, in step S405, a grayscale adjustment step $G_{step}$ is selected. In step S406, an adjusted grayscale value $G_{out}=G_{in}+G_{step}$ is determined according to a sum of the second grayscale value and the selected grayscale adjustment step, where $G_{in}$ represents an input second grayscale value, and $G_{out}$ represents an output adjusted grayscale value.

Next, in step S407, display brightness data $L'_1$, $L'_2$, . . . , $L'_i$, $L'_{i+1}$ of the at least one frame of to-be-compensated picture and the reference picture displayed after the display picture of the display device is switched from the first grayscale value to the determined adjusted grayscale value are acquired. According to an embodiment, acquiring display brightness data of the at least one frame of to-be-compensated picture and the reference picture displayed after the display picture of the display device is switched from the first grayscale value to the determined adjusted grayscale value includes: displaying the at least one frame of to-be-compensated picture and the reference picture sequentially after the display device displays a first picture with the first grayscale value, by using the determined adjusted grayscale value as a grayscale value of the at least one frame of to-be-compensated picture and the reference picture, and collecting the display brightness of the at least one frame of to-be-compensated picture and the reference picture. $L'_1$, $L'_2$, . . . $L'_i$, $L'_{i+1}$ may be acquired with reference to the method for acquiring display brightness data of the multiple frames of pictures in the above-mentioned embodiments. It should be noted that, in the embodiments, the number of second pictures with the second grayscale value (i.e., the adjusted grayscale value) that needs to be displayed is a sum of the number of the determined at least one frame of to-be-compensated pictures and the number (i.e., 1 frame) of the reference picture.

Next, in step S408, the ratio of the collected display brightness of each frame of to-be-compensated picture to the collected display brightness of the reference picture is calculated according to the following expression (2):

$$M'(j)=L'_j/L'_{i+1} \quad (2)$$

In the formula, M'(j) represents a ratio of a brightness L'j of a j-th frame of to-be-compensated picture in the at least one frame of to-be-compensated picture to a display brightness $L'_{i+1}$ of the reference picture, i is a frame number of to-be-compensated pictures determined in step S404, j is a natural number, j=1, 2, . . . , i.

Next, in step S409, the ratio M'(j) of the collected display brightness of each frame of to-be-compensated picture to the display brightness of the reference picture is compared with the preset first brightness threshold $TH_1$. Here, $TH_1$ has the same meaning as that of the first brightness threshold in the above-mentioned embodiments. If the ratio M'(j) of the collected display brightness of each frame of to-be-compensated picture to the display brightness of the reference picture is less than the first brightness threshold $TH_1$, the process returns to step S405, which indicates that the selected grayscale adjustment step is small and still insufficient to produce sufficient brightness. Step S405 to step S409 are repeatedly performed until it is determined that the ratio M'(j) of the collected display brightness of each frame of to-be-compensated picture to the display brightness of the reference picture is greater than or equal to the first brightness threshold $TH_1$, and then the loop is exited. Then, in step S410, the selected grayscale adjustment step is determined as the grayscale compensation value of the at least one frame of to-be-compensated picture.

In the embodiments, two compensation parameters are determined, that is, the number of to-be-compensated pictures and the grayscale compensation value. In a practical application, a compensated grayscale value may be calculated according to the grayscale compensation value, and the to-be-compensated pictures with the compensated grayscale value are displayed multiple times according to the number of the to-be-compensated pictures.

According to an embodiment, the grayscale adjustment step may be selected according to a binding point voltage used by a Gamma unit included in the display device. For example, the grayscale adjustment step may be selected as an integer multiple of a grayscale represented by a minimum resolution of the binding point voltage of the Gamma unit.

Figures 5, 6:
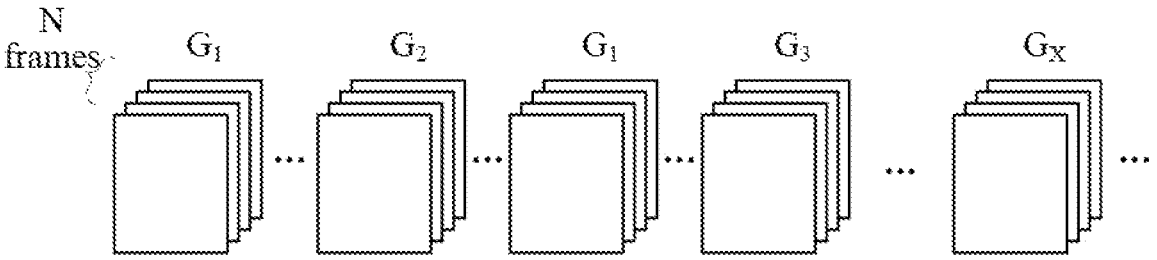
FIG. 5 schematically shows a process of performing a picture switching among a plurality of display pictures with different grayscale values.
FIG. 6 schematically shows an example of a brightness compensation lookup table.

The process of determining compensation parameters in the above-mentioned embodiments is performed for the switching of a pair of grayscale values. Further, two sets of grayscale values may be traversed for switching, which are respectively recorded as a first set of grayscale values and a second set of grayscale values. A process of switching a picture grayscale value from a first grayscale value in the first set of grayscale values to a second grayscale value in the second set of grayscale values is simulated, and the first grayscale value is guaranteed to be less than the second grayscale value. For example, the first set of grayscale values P may include m first grayscale values, that is, $P=\{G_{11}, G_{12}, G_{13}, \ldots, G_{1m}\}$, and the second set of grayscale values Q may include n second grayscale values, that is, $Q=\{G_{21}, G_{22}, G_{23}, \ldots, G_{2n}\}$, in which m and n are natural numbers. The number of grayscale values contained in P and Q may not be equal, that is, $m \neq n$. When switching from the first grayscale value to the second grayscale value, for any set of $G_{1i} \rightarrow G_{2j}$, "→" represents a switching between grayscale values, $1 \leq i \leq m$, $1 \leq j \leq n$, i and j are both natural numbers, and a value of $G_{1i}$ is less than a value of $G_{2j}$. In other embodiments, P and Q may include the same grayscale value, that is, $P=\{G_1, G_2, G_3, \ldots, G_x\}$, $Q=\{G_1, G_2, G_3, \ldots, G_x\}$. If $G_1, G_2, G_3, \ldots, G_x$ are grayscale values arranged from small to large, $G_1 \rightarrow G_2$, $G_1 \rightarrow G_3$, . . . $G_1 \rightarrow G_x$, . . . may be performed, and all combinations of P and Q grayscale values may be traversed. FIG. 5 schematically shows a process of performing a picture switching among a plurality of display pictures with different grayscale values. As shown in FIG. 5, the display device first displays N frames of first pictures with a grayscale value $G_1$, then displays N frames of second pictures with a grayscale value $G_2$, then displays the N frames of first pictures with the grayscale value $G_1$, and then displays N frames of second pictures with a grayscale value $G_3$, and so on, so that all tests of switching from the grayscale value $G_1$ to grayscale values $G_2, G_3, \ldots G_x$ may be quickly completed. Further, according to an embodiment, the grayscale values $G_1, G_2, G_3, \ldots G_x$ selected in the above-mentioned embodiments may all be grayscale values associated with a specific binding point voltage.

In addition, it should be noted that, in the embodiments of the present disclosure, only a scene when switching from a low-grayscale picture to a high-grayscale picture in the display device is simulated. This is because, although the display device may also cause a sliding tail when switching from the high-grayscale picture to the low-grayscale picture, a tailing may not be distinguished from a display of the picture, that is, the human eye may not distinguish the the tailing. That is to say, the tailing in this case may not affect the user's visual experience. However, it may be understood that a brightness may be detected by using an optical test probe. Therefore, a scene when switching from the high-grayscale picture to the low-grayscale picture may be simulated based on a simulation principle of the scene when switching from the low-grayscale picture to the high-grayscale picture in the embodiments of the present disclosure.

According to the embodiments of the present disclosure, the compensation parameters may be determined for a switching between a plurality of sets of different grayscale values, and thus a grayscale compensation value lookup table may be formed and burned into a display driver IC (DDIC) for driving the display device. FIG. 6 schematically shows an example of a brightness compensation lookup table. As shown in FIG. 6, when a switching from the grayscale value $G_1$ to a grayscale value $G_5$ occurs, $G_1$ may be selected from a column representing the first grayscale value, $G_5$ may be selected from a row representing the second grayscale value, and the stored grayscale compensation value may be acquired from an intersection of the two. As shown in FIG. 6, "*" represents an example of the grayscale compensation value.

Figure 7:
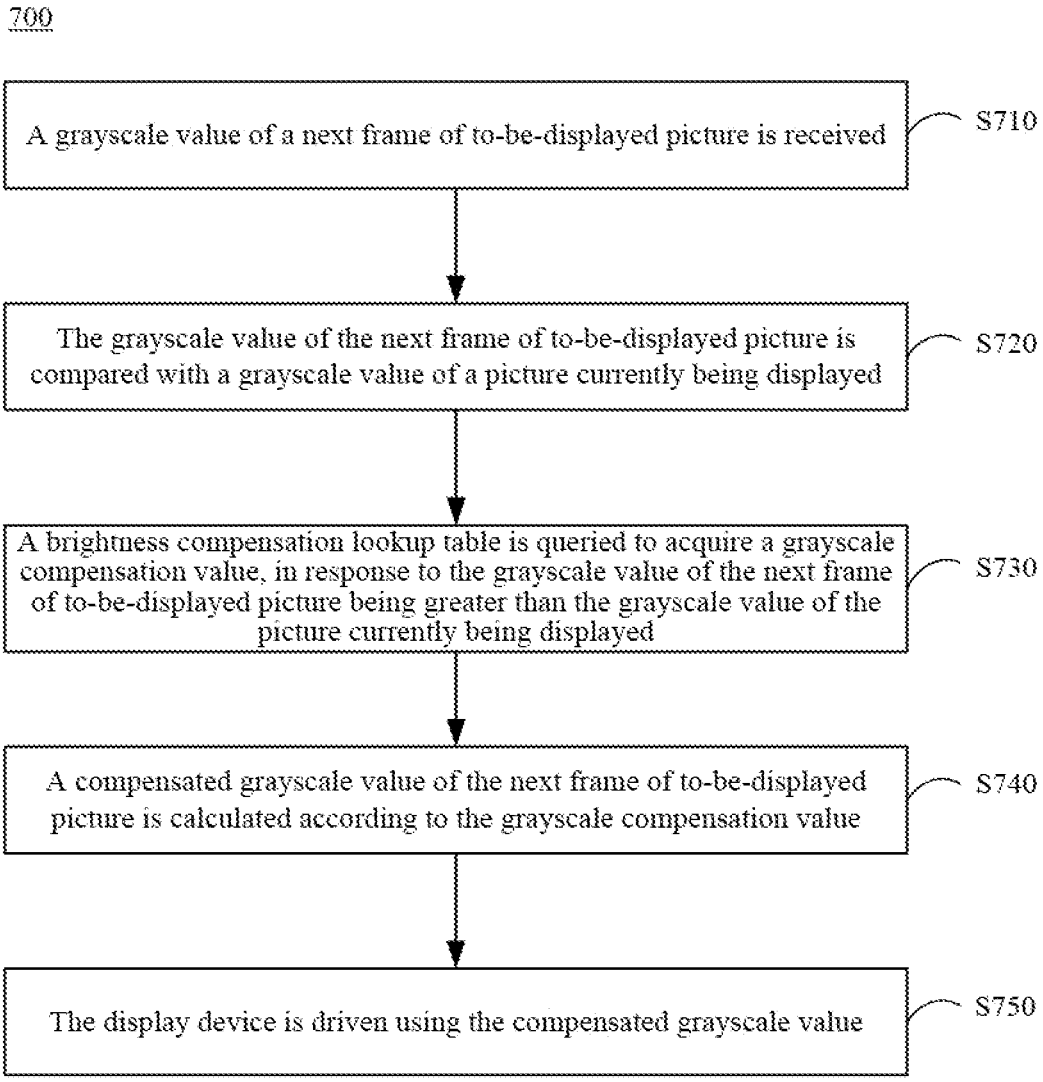
FIG. 7 schematically shows a flowchart of a method of driving a display device according to another embodiment of the present disclosure.

FIG. 7 schematically shows a flowchart of a method 700 for driving a display device according to another embodiment of the present disclosure. As shown in FIG. 7, the driving method 700 includes step S710 to step S750 as follows.

In step S710, a grayscale value of a next frame of to-be-displayed picture is received.

In step S720, the grayscale value of the next frame of to-be-displayed picture is compared with a grayscale value of a picture currently being displayed.

In step S730, in a case where the grayscale value of the next frame of to-be-displayed picture is greater than the grayscale value of the picture currently being displayed, a brightness compensation lookup table is queried to acquire a grayscale compensation value.

In step S740, a compensated grayscale value of the next frame of to-be-displayed picture is calculated according to the grayscale compensation value.

In step S750, the display device is driven using the compensated grayscale value.

The grayscale compensation value in the brightness compensation lookup table in the embodiments of the present disclosure may be determined according to the method of the above-mentioned embodiments. The specific form of the brightness compensation lookup table is shown in FIG. 6. Further, the compensation parameters also include the number of the to-be-compensated pictures. In the embodiments, the number of the to-be-compensated pictures may also be stored in the brightness compensation lookup table, so that when the display device is driven, the number of pictures with the compensated grayscale value to be displayed is determined according to the number of the to-be-compensated pictures. In some other embodiments, the number of the to-be-compensated pictures may be additionally stored as an independent lookup table. When the display device is driven, two lookup tables may be simultaneously searched to acquire the compensation parameters.

Figure 8:
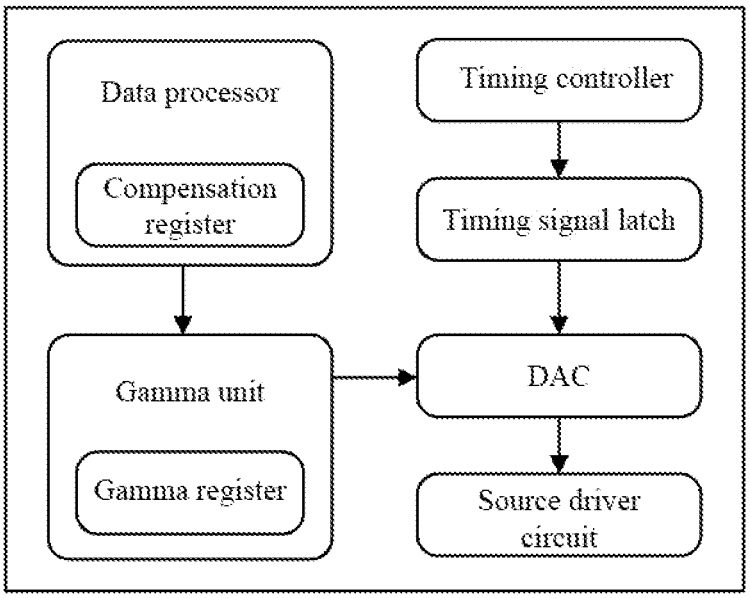
FIG. 8 schematically shows a block diagram of a DDIC that performs the method of driving a display device shown in FIG. 7.

FIG. 8 schematically shows a block diagram of a DDIC that performs the method 700 for driving a display device shown in FIG. 7. As shown in FIG. 8, firstly, the data processor receives the grayscale value of the next frame of to-be-displayed picture. Then, the data processor compares the received grayscale value of the next frame of to-be-displayed picture with the grayscale value of the picture currently being displayed. If it is determined that the grayscale value of the next frame of to-be-displayed picture is greater than the picture currently being displayed, the brightness compensation lookup table stored in the compensation register is called to start a compensation process. If it is determined that the grayscale value of the next frame of to-be-displayed picture is less than or equal to the grayscale value of the picture currently being displayed, the compensation process is not called, and the displaying is performed directly using the received grayscale value. After the compensation process is started, the data processor acquires the grayscale compensation value from the brightness compensation lookup table. According to an embodiment, querying a brightness compensation lookup table to acquire a grayscale compensation value includes: determining a first lower limit grayscale value a and a first upper limit grayscale value a' in the brightness compensation lookup table according to the grayscale value m of the picture currently being displayed, so that $a \le m \le a'$; determining a second lower limit grayscale value b and a second upper limit grayscale value b' in the brightness compensation lookup table according to the grayscale value n of the next frame of to-be-displayed picture, so that $b \le n \le b'$; and querying the brightness compensation lookup table according to the a, a', b, and b', to acquire a grayscale compensation value $G_{off}(a, b)$ for switching from the first lower limit grayscale value a to the second lower limit grayscale value b, a grayscale compensation value $G_{off}(a', b)$ for switching from the first upper limit grayscale value a' to the second lower limit grayscale value b, a grayscale compensation value $G_{off}(a, b')$ for switching from the first lower limit grayscale value a to the second upper limit grayscale value b', and a grayscale compensation value $G_{off}(a', b')$ for switching from the first upper limit grayscale value a' to the second upper limit grayscale value b'.

In the embodiments, a grayscale value of the display picture is switched from m to n, m and n are not necessarily values that may be directly acquired in the brightness compensation lookup table, and the grayscale compensation value needs to be determined by a linear interpolation method. After $G_{off}(a, b)$, $G_{off}(a', b)$, $G_{off}(a, b')$ and $G_{off}(a', b')$ are acquired by querying, the data processor calculates the compensated grayscale value m' of the next frame of to-be-displayed picture according to the following expression (3):

$$m' = m + \frac{(m-a)(n-b)}{(a'-a)(b'-b)} \times [G_{off}(a, b) + G_{off}(a', b') - G_{off}(a', b) - G_{off}(a, b')] \quad (3)$$

Next, as shown in FIG. 8, the processor sends the calculated compensated grayscale value m' to the Gamma unit. The Gamma unit calls Gamma information in a Gamma register to process m' so as to acquire corresponding Gamma data, and outputs the processed Gamma data to a digital-to-analog converter. The digital-to-analog converter simultaneously receives a timing control signal provided by a timing controller from a timing signal latch, so as to provide a source driver circuit with a compensated data voltage according to a set timing.

According to the driving method of the embodiments of the present disclosure, a brightness of several initial frames of pictures in a picture switching process may be compensated by acquiring the grayscale compensation value based on the brightness compensation lookup table, thereby improving the sliding tail and improving the user's visual experience.

According to an embodiment, the data processor also acquires the number of the to-be-compensated pictures while querying the brightness compensation lookup table, which may be acquired by reading the brightness compensation lookup table (stored in the same lookup table), or acquired by reading another separate lookup table (stored separately in another lookup table).

According to an embodiment, an actual compensation process is associated with a relative change in a grayscale value of each frame of to-be-displayed picture. For example, grayscale values of 6 frames of to-be-displayed picture pictures are $G_1$, $G_2$, $G_3$, $G_3$, $G_3$, and $G_3$ in sequence, and the grayscale values increase sequentially, that is, $G_1 < G_2 < G_3$. A compensation rule acquired by querying the brightness compensation lookup table is that when $G_1 \rightarrow G_2$, 2 frames need to be compensated, and the grayscale compensation value is $G_{12}$; when $G_2 \rightarrow G_3$, 2 frames need to be compensated, and the grayscale compensation value is $G_{23}$. Then, during a compensation driving, the data processor first starts a first compensation driving process according to $G_1 < G_2$, and calculates a compensated grayscale value $G'_1$ according to $G_{12}$. In the first compensation process, 3 frames of pictures should be displayed with the compensated grayscale value $G'_1$ after the picture with the grayscale value $G_1$ is displayed. However, after displaying the $1^{st}$ frame of compensation picture after switching from $G_1 \rightarrow G_2$ with the compensated grayscale value $G'_1$, the data processor also starts a second compensation process according to $G_2 < G_3$, and the data processor acquires a compensated grayscale value $G'_2$ through calculation. According to an embodiment, if there is a superposition between the first compensation process and the second compensation process, the first compensation process will be interrupted. That is, after displaying the $1^{st}$ frame of compensation picture after switching from $G_1 \rightarrow G_2$ with the compensated grayscale value $G'_1$, the $2^{nd}$ frame of compensation picture after switching from $G_1 \rightarrow G_2$, or the $1^{st}$ frame of compensation picture after switching from $G_2 \rightarrow G_3$ may be displayed with the compensated grayscale value $G'_2$. Next, the data processor continues to be used for determination. Since grayscale values of next 3 frames of pictures are all $G_3$, it is determined not to start the compensation process. Therefore, after the $1^{st}$ frame of compensation picture after switching from $G_2 \rightarrow G_3$ is displayed with the compensated grayscale value $G'_2$, the $2^{nd}$ frame of compensation picture and the $3^{rd}$ frame of reference picture after switching from $G_2 \rightarrow G_3$ are continuously displayed with the compensated grayscale value $G'_2$. After a compensation display of initial 3 frames of pictures after switching from $G_2 \rightarrow G_3$ is completed, the display may continue with an uncompensated grayscale value $G_3$. Therefore, grayscale values of actual display pictures are $G_1$, $G'_1$, $G'_2$, $G'_2$, $G'_2$, and $G_3$ in sequence.

In addition, it should be noted that a principle of consistent compensation rules needs to be followed in the compensation process, that is, in a process of creating the brightness compensation lookup table, if the reference picture is displayed using the compensated grayscale value (or the adjusted grayscale value) so as to determine a compensation of grayscale values, for example, as shown in step S407 in FIG. 4, the reference picture is also displayed using the compensated grayscale value during a driving process. For example, in an embodiment in which 6 frames of pictures with the grayscale values of $G_1$, $G_2$, $G_3$, $G_3$, $G_3$ and $G_3$ are to be displayed in sequence, although a switching from $G_2$ to $G_3$ requires 2 frames of to-be-displayed pictures, 3 frames, that is, 2 frames of to-be-compensated pictures and 1 frame of reference picture, are displayed when actually displayed. This is because when the brightness compensation lookup table is created, the grayscale compensation value determined according to the ratio of the display brightness of to-be-compensated picture to the display brightness of the reference picture is a grayscale compensation value determined by using a display brightness of a compensated reference picture. It may be understood that, in the step of acquiring display brightness data of the at least one frame of to-be-compensated picture and the reference picture displayed after the display picture of the display device is switched from the first grayscale value to the determined adjusted grayscale value, the display brightness of the reference picture is not acquired by displaying the reference picture with the adjusted grayscale value, but a calculation is performed by the display brightness of the reference picture displayed with the second grayscale value. Since the display brightness between several initial frames of pictures after the picture switching affects each other, the display brightness of the reference picture is preferably acquired by displaying the reference picture with the adjusted grayscale value.

In addition, according to an embodiment, a red compensation lookup table, a green compensation lookup table and a blue compensation lookup table may be created respectively, and in the step of querying the brightness compensation lookup table to acquire a grayscale compensation value, the red compensation lookup table, the green compensation lookup table, and the blue compensation lookup table are respectively queried to acquire a red grayscale compensation value, a green grayscale compensation value, and a blue grayscale compensation value, respectively. Then, brightness compensations are respectively performed on a red sub-pixel, a green sub-pixel and a blue sub-pixel of the display device according to the acquired red grayscale compensation value, green grayscale compensation value and blue grayscale compensation value. This is because a desired picture, such as a white picture, may be displayed only when brightness of the red sub-pixel, the green sub-pixel and the blue sub-pixel all achieve their respective desired brightness. If the brightness of one of the sub-pixels does not achieve the desired brightness, a change in the picture may occurs. For example, if the brightness of the blue sub-pixel does not achieve the desired brightness, there will be a slight yellow in the picture, that is, a color sliding tail may occur. According to the embodiments of the present disclosure, compensations are performed for different colors respectively, so that the color sliding tail may be improved or eliminated.

In addition, it should be noted that the display brightness of the display device is closely related to the performance of the display device itself, so the compensation parameters determined for a display device are not applicable to other display devices, and each display device needs to be tested and compensated separately.

Figure 9:
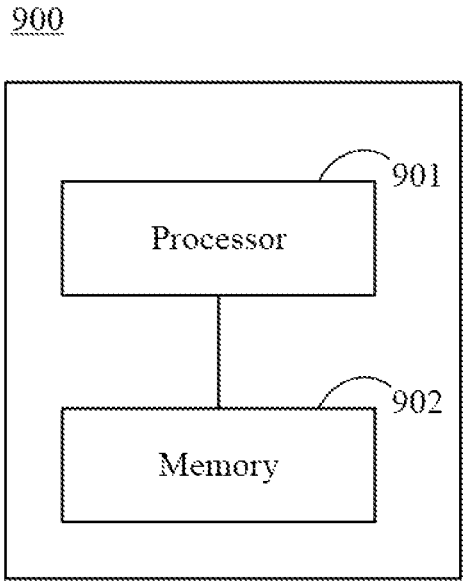
FIG. 9 schematically shows a block diagram of a device of compensating a brightness according to another embodiment of the present disclosure.

FIG. 9 schematically shows a block diagram of a device of compensating a brightness according to another embodiment of the present disclosure. As shown in FIG. 9, the device 900 of compensating a brightness includes a processor 901 and a memory 902. The memory 902 stores machine-readable instructions, and the processor 901 may execute these machine-readable instructions to implement the method 100 for compensating a brightness of a display device according to the embodiments of the present disclosure.

The memory 902 may be in the form of non-volatile or volatile memory, e.g., an electrically erasable programmable read only memory (EEPROM), a flash memory, and the like.

Various components inside the device 900 of compensating a brightness according to the embodiments of the present disclosure may be implemented by various devices, including but not limited to: an analog circuit device, a digital circuit device, a digital signal processing (DSP) circuit, a programmable processor, an Application Specific Integrated Circuit (ASIC), a Field Programmable Gate Array (FPGA), a Programmable Logic Device (CPLD), and the like.

Figure 10:
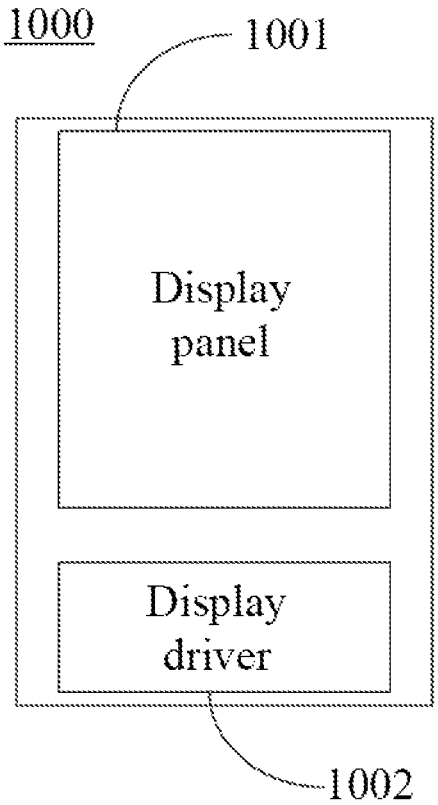
FIG. 10 schematically shows a block diagram of a display device according to another embodiment of the present disclosure.

FIG. 10 schematically shows a block diagram of a display device 1000 according to another embodiment of the present disclosure. As shown in FIG. 10, the display device 1000 according to the embodiments of the present disclosure includes a display panel 1001 and a display driver DDIC 1002 according to the embodiments of the present disclosure. The DDIC 1002 is connected to the display panel 1001 for driving the display panel 1001. The display device 1000 according to the embodiments of the present disclosure may be any product or component with a display function, such as an electronic paper, a mobile phone, a tablet computer, a television, a monitor, a notebook computer, a digital photo frame, a navigator, and the like.

Furthermore, the embodiments of the present disclosure may be implemented on a computer program product. More specifically, the computer program product is a product having a computer-readable medium on which a computer program logic is encoded. When executed on a computing device, the computer program logic provides relevant operations to achieve the above-mentioned technical solutions of the present disclosure. When executed on at least one processor of a computing system, the computer program logic causes the processor to perform the operations (methods) described in the embodiments of the present disclosure. The arrangement of the present disclosure is typically provided as a software, a code and/or other data structures arranged or encoded on a computer-readable medium, such as an optical medium (e.g., CD-ROM), a floppy disk or a hard disk, or other mediums such as a firmware or microcode on one or more ROM or RAM or PROM chips, or downloadable software images in one or more modules, a shared database or the like. The software or firmware or the configuration may be installed on the computing device so that one or more processors in the computing device execute the technical solutions described in the embodiments of the present disclosure.

It should be noted that, in the above-mentioned description, the technical solutions of the embodiments of the present disclosure are shown only by way of example, which does not mean that the embodiments of the present disclosure are limited to the above-mentioned steps and structures. Where possible, the steps and structures may be adjusted and selected as needed. Therefore, some steps and units are not necessary elements for implementing the general inventive concept of the embodiments of the present disclosure.

So far, the present disclosure has been described in conjunction with the preferred embodiments. It should be understood that various other changes, substitutions and additions may be made by those skilled in the art without departing from the spirit and scope of the embodiments of the present disclosure. Accordingly, the scope of embodiments of the present disclosure should not be limited to the above-mentioned specific embodiments, but should be defined by the appended claims.

What is claimed is:

1. A method of compensating a brightness for a display device, comprising:

acquiring display brightness data of multiple frames of pictures displayed after a display picture of the display device is switched from a first grayscale value to a second grayscale value;

determining a brightness coefficient of each frame of picture in the multiple frames of pictures according to the display brightness data of the multiple frames of pictures;

determining a reference picture and at least one frame of to-be-compensated picture in the multiple frames of pictures according to the brightness coefficient; and determining a grayscale compensation value of the at least one frame of to-be-compensated picture, so that a ratio of a display brightness of each frame of to-be-compensated picture in the at least one frame of to-be-compensated picture displayed by the display device to a display brightness of the reference picture displayed by the display device is greater than or equal to a preset first brightness threshold.

2. The method according to claim 1, wherein the acquiring display brightness data of multiple frames of pictures displayed after a display picture of the display device is switched from a first grayscale value to a second grayscale value comprises:

displaying multiple frames of second pictures with the second grayscale value sequentially after the display device displays a first picture with the first grayscale value; and collecting display brightness data of the multiple frames of second pictures.

3. The method according to claim 2, wherein the display picture is a red picture, a green picture or a blue picture, and the first grayscale value is less than the second grayscale value.

4. The method according to claim 2, wherein the brightness coefficient of each frame of picture in the multiple frames of pictures is determined according to:

$$M(i)=L_i/\max\{L_1,L_2,\ldots,L_N\}$$

wherein M(i) represents a brightness coefficient of an i-th frame of picture in the multiple frames of images, $L_i$ represents a brightness of the i-th frame of picture, i is a natural number, i=1, 2, . . . , N, and N is the number of the multiple frames of pictures.

5. A method of driving a display device, comprising:

receiving a grayscale value of a next frame of to-be-displayed picture;

comparing the grayscale value of the next frame of to-be-displayed picture with a grayscale value of a picture currently being displayed;

querying, in response to the grayscale value of the next frame of to-be-displayed picture being greater than the grayscale value of the picture currently being displayed, a brightness compensation lookup table to acquire a grayscale compensation value;

calculating a compensated grayscale value of the next frame of to-be-displayed picture according to the grayscale compensation value; and driving the display device using the compensated grayscale value;

wherein the grayscale compensation value in the brightness compensation lookup table is determined based on the method according to claim 2.

6. The method according to claim 1, wherein the brightness coefficient of each frame of picture in the multiple frames of pictures is determined according to:

$$M(i)=L_i/\max\{L_1,L_2,\ldots,L_N\}$$

wherein M(i) represents a brightness coefficient of an i-th frame of picture in the multiple frames of images, $L_i$ represents a brightness of the i-th frame of picture, i is a natural number, i=1, 2, . . . , N, and N is the number of the multiple frames of pictures.

7. A method of driving a display device, comprising:

receiving a grayscale value of a next frame of to-be-displayed picture;

comparing the grayscale value of the next frame of to-be-displayed picture with a grayscale value of a picture currently being displayed;

querying, in response to the grayscale value of the next frame of to-be-displayed picture being greater than the grayscale value of the picture currently being displayed, a brightness compensation lookup table to acquire a grayscale compensation value;

calculating a compensated grayscale value of the next frame of to-be-displayed picture according to the grayscale compensation value; and driving the display device using the compensated grayscale value;

wherein the grayscale compensation value in the brightness compensation lookup table is determined based on the method according to claim 6.

8. The method according to claim 1, wherein the determining a reference picture and at least one frame of to-be-compensated picture in the multiple frames of pictures according to the brightness coefficient comprises:

comparing the brightness coefficient of each frame of picture with a preset second brightness threshold respectively; and determining, in response to a brightness coefficient of a former frame of picture in two adjacent frames of pictures being less than the second brightness threshold and a brightness coefficient of a latter frame of picture in the two adjacent frames of pictures being greater than or equal to the second brightness threshold, the latter frame of picture as the reference picture, and determining each frame of picture before the latter frame of picture as the at least one frame of to-be-compensated picture.

9. A method of driving a display device, comprising:

receiving a grayscale value of a next frame of to-be-displayed picture;

comparing the grayscale value of the next frame of to-be-displayed picture with a grayscale value of a picture currently being displayed;

querying, in response to the grayscale value of the next frame of to-be-displayed picture being greater than the grayscale value of the picture currently being displayed, a brightness compensation lookup table to acquire a grayscale compensation value;

calculating a compensated grayscale value of the next frame of to-be-displayed picture according to the grayscale compensation value; and driving the display device using the compensated grayscale value;

wherein the grayscale compensation value in the brightness compensation lookup table is determined based on the method according to claim 8.

10. The method according to claim 1, wherein the determining a grayscale compensation value of the at least one frame of to-be-compensated picture, so that a ratio of a display brightness of each frame of to-be-compensated picture in the at least one frame of to-be-compensated picture displayed by the display device to a display brightness of the reference picture displayed by the display device is greater than or equal to a preset first brightness threshold comprises:

operation a, selecting a grayscale adjustment step;

operation b, determining an adjusted grayscale value according to a sum of the second grayscale value and the selected grayscale adjustment step;

operation c, acquiring display brightness data of the at least one frame of to-be-compensated picture and the reference picture displayed after the display picture of the display device is switched from the first grayscale value to the determined adjusted grayscale value;

repeating operations a to c in response to a ratio of the collected display brightness of each frame of to-be-compensated picture to the display brightness of the reference picture being less than the preset first brightness threshold, until the ratio of the display brightness of each frame of to-be-compensated picture in the at least one frame of to-be-compensated picture to the display brightness of the reference picture is greater than or equal to the preset first brightness threshold; and determining the selected grayscale adjustment step as the grayscale compensation value of the at least one frame of to-be-compensated picture.

11. The method according to claim 10, wherein the acquiring display brightness data of the at least one frame of to-be-compensated picture and the reference picture displayed after the display picture of the display device is switched from the first grayscale value to the determined adjusted grayscale value comprises:

displaying the at least one frame of to-be-compensated picture and the reference picture sequentially after the display device displays a first picture with the first grayscale value, by using the determined adjusted grayscale value as a grayscale value of the at least one frame to be compensated and the reference picture; and collecting the display brightness of the at least one frame of to-be-compensated picture and the reference picture.

12. The method according to claim 11, wherein the display device comprises a Gamma unit;

wherein the grayscale adjustment step is selected according to an integer multiple of a grayscale represented by a minimum resolution of a binding point voltage of the Gamma unit.

13. The method according to claim 10, wherein the display device comprises a Gamma unit;

wherein the grayscale adjustment step is selected according to an integer multiple of a grayscale represented by a minimum resolution of a binding point voltage of the Gamma unit.

14. A method of driving a display device, comprising:

receiving a grayscale value of a next frame of to-be-displayed picture;

comparing the grayscale value of the next frame of to-be-displayed picture with a grayscale value of a picture currently being displayed;

querying, in response to the grayscale value of the next frame of to-be-displayed picture being greater than the grayscale value of the picture currently being displayed, a brightness compensation lookup table to acquire a grayscale compensation value;

calculating a compensated grayscale value of the next frame of to-be-displayed picture according to the grayscale compensation value; and driving the display device using the compensated grayscale value;

wherein the grayscale compensation value in the brightness compensation lookup table is determined based on the method according to claim 1.

15. The method according to claim 14, wherein the querying a brightness compensation lookup table to acquire a grayscale compensation value comprises:

determining a first lower limit grayscale value a and a first upper limit grayscale value a' in the brightness compensation lookup table according to the grayscale value m of the picture currently being displayed, so that $a \le m \le a'$;

determining a second lower limit grayscale value b and a second upper limit grayscale value b' in the brightness compensation lookup table according to the grayscale value n of the next frame of to-be-displayed picture, so that $b \le n \le b'$; and querying the brightness compensation lookup table according to the a, a', b, and b', to acquire a grayscale compensation value Goff(a, b) for switching from the first lower limit grayscale value a to the second lower limit grayscale value b, a grayscale compensation value $G_{off}(a', b)$ for switching from the first upper limit grayscale value a' to the second lower limit grayscale value b, a grayscale compensation value $G_{off}(a, b')$ for switching from the first lower limit grayscale value a to the second upper limit grayscale value b', and a grayscale compensation value $G_{off}(a', b')$ for switching from the first upper limit grayscale value a' to the second upper limit grayscale value b'.

16. The method according to claim 15, wherein the compensated grayscale value m' of the next frame of to-be-displayed picture is calculated according to:

$$m' = m + \frac{(m-a)(n-b)}{(a'-a)(b'-b)} \times [G_{off}(a, b) + G_{off}(a', b') - G_{off}(a', b) - G_{off}(a, b')].$$

17. The method according to claim 14, wherein the brightness compensation lookup table comprises a red compensation lookup table, a green compensation lookup table and a blue compensation lookup table;

wherein the querying the brightness compensation lookup table to acquire a grayscale compensation value comprises:

querying the red compensation lookup table, the green compensation lookup table, and the blue compensation lookup table respectively to acquire a red grayscale compensation value, a green grayscale compensation value, and a blue grayscale compensation value, respectively.

18. A device of compensating a brightness, comprising:

a memory configured to store program instructions; and a processor configured to execute the program instructions so as to perform the method of claim 1.

19. A display driver, comprising:

a data processor comprising a compensation register having a brightness compensation lookup table stored therein, wherein a grayscale compensation value in the brightness compensation lookup table is determined based on the method according to claim 1; and the data processor is configured to:

receive a grayscale value of a next frame of to-be-displayed picture;

compare the grayscale value of the next frame of to-be-displayed picture with a grayscale value of a picture currently being displayed;

query, in response to the grayscale value of the next frame of to-be-displayed picture being greater than the grayscale value of the picture currently being displayed, the brightness compensation lookup table to acquire the grayscale compensation value;

calculate a compensated grayscale value of the next frame of to-be-displayed picture according to the grayscale compensation value; and drive a display device using the compensated grayscale value.

20. A display device, comprising:

a display panel; and the display driver according to claim 19.

* * * * *